US006047577A

United States Patent [19]

Klimas

[11] Patent Number: 6,047,577

[45] Date of Patent: Apr. 11, 2000

[54] ABNORMAL USE INDICATOR FOR DOOR LOCK

[76] Inventor: Frank Klimas, 709 N. Waiola, LaGrange Park, Ill. 60526

[21] Appl. No.: 09/169,420

[22] Filed: Oct. 9, 1998

[51] Int. Cl.[7] ..... E05B 35/10; E05B 17/00

[52] U.S. Cl. ..... 70/340; 70/432; 70/441; 70/DIG. 59; 70/493

[58] Field of Search ..... 70/337, 340, 432, 70/441, DIG. 59, 433, 436, 439, 358, 493, DIG. 23, DIG. 37, 356

[56] References Cited

U.S. PATENT DOCUMENTS

| | | | |
|---|---|---|---|
| 671,636 | 4/1901 | Scharnweber | 70/432 |
| 718,359 | 1/1903 | Koerber | 70/432 |
| 856,843 | 6/1907 | Carlisle | 70/DIG. 59 |
| 1,161,158 | 11/1915 | Rennert | 70/432 |
| 3,059,462 | 10/1962 | Check | 70/493 |
| 3,128,618 | 4/1964 | DeVines | 70/493 |
| 3,348,220 | 10/1967 | Luna et al. | 70/432 |
| 3,503,642 | 3/1970 | Poe | 70/432 |
| 3,824,819 | 7/1974 | Neary | 70/432 |
| 4,328,692 | 5/1982 | Dice et al. | 70/441 |
| 4,591,852 | 5/1986 | Brod | 70/433 |
| 4,656,851 | 4/1987 | Leek et al. | 70/441 |

*Primary Examiner*—Darnell M. Boucher
*Attorney, Agent, or Firm*—Dvorak & Orum

[57] ABSTRACT

A door lock particularly suited for an apartment or condominium where the resident has an entry key and management personnel also have a key that will allow access to the apartment, the door lock having a spring loaded axial pin which is retained in an externally visible position when the lock is actuated by the resident's key and which is released to an externally non-visible position when the lock is actuated by the management key.

8 Claims, 2 Drawing Sheets

RESIDENT'S KEY
MANAGEMENT KEY

ABNORMAL USE INDICATOR FOR DOOR LOCK

FIELD OF THE INVENTION

In multi-family dwellings such as apartments or condominiums, the resident has an entry key to his main entry door. It is necessary on occasion that there be a management or superintendent's key that would enable access to the apartment in the resident's absence, particularly in case of emergency such as broken pipes, flooding, fire, or other situations that might cause damage not only to the apartment but to other apartments in the building.

Such use of a management key is to be limited only to emergencies. The resident has an interest in knowing if and when the management key has been used to gain entry into his apartment. The present invention provides a means of disclosing when a management key has been used to gain entry into a locked apartment or space.

BACKGROUND OF THE INVENTION

Various means, both mechanical and electrical have been utilized to provide to the resident's an indication of the usage of a management key, which is so formed with ridges that the key will perform the usual function of unlocking the door, but which has a configuration which will initiate a signaling arrangement.

OBJECT OF THE INVENTION

The object of the present invention is to provide a cylinder or tumbler lock which utilizes a row of radial pins in the stationary and rotable parts which when positioned by the ridges of an inserted proper key will line up in such a fashion that a rotable core or cylinder of the lock is free to be turned to effect an actuation of a lock. A further radial pin arrangement in the lock will be actuated only upon use of a management key, but not the resident's key. When this occurs, an axial pin within the lock structure will be displaced from its outwardly visible position to a position where it is not outwardly visible, thereby indicating to the owner that the management key had been used to gain entry into the locked space.

Further, the structure of the present invention is such that the management key cannot be modified by relatively simple filing of key grooves to conform this key to the resident's key. Rather, the management key would be required to have material added to the grooves, to conform it to a resident's key which is too complicated to be of real concern.

BRIEF DISCLOSURE OF THE INVENTION

This invention utilizes a conventional cylinder lock with a rotating cylinder having a key slot which engages a key. The structure includes a row of radiant disposed channels in the lock housing and in the rotable cylinder and which accommodate slidable pins of varying lengths. The function of the lock is to have a grooved key so configured that it will displace pins within the channel of a rotating cylinder to a position where they will meet a shear line between the cylinder and the housing so there will be no obstruction against turning of the cylinder by either an extending pin in the cylinder or in the housing.

This invention utilizes a second angularly-displaced row of one or more radial channels in the housing and cylinder which accommodates a spring-loaded pin. The use of a management key, because of its unique configuration of ridge structure, will, when the cylinder is turned, enable a ball or the like in the housing channel to slip into an aligned channel of the cylinder.

Such radial movement of the ball permits release of a spring-loaded axial pin.

The distal end of the axial pin is normally visible from the outside of the lock plate, but when triggered and released, it moves inwardly from the lock plate, and thereby, it is not visible and the resident can see that entry has been made by the use of the management key.

Once the axial pin has been triggered, it must be reset to the cocked position.

INDICATOR FOR ABNORMAL USE OF LOCK FIELD OF INVENTION

DESCRIPTION OF THE PREFERRED EMBODIMENTS OF THE INVENTION

Cylinder locks are well known in the art, and therefore will not be described in detail. Instead the invention comprising an improvement in the art will be described straightaway. FIGS. 1, 3, 5 and 7 show the position of the rotating cylinder 3 at the angular position shown by lines I—I in FIG. 2, for example.

The key 11 of the owner or resident of the locked space is so ridged, that it has no effect on the indicator arrangement.

Figures 5, 6, 7, 8, 9:
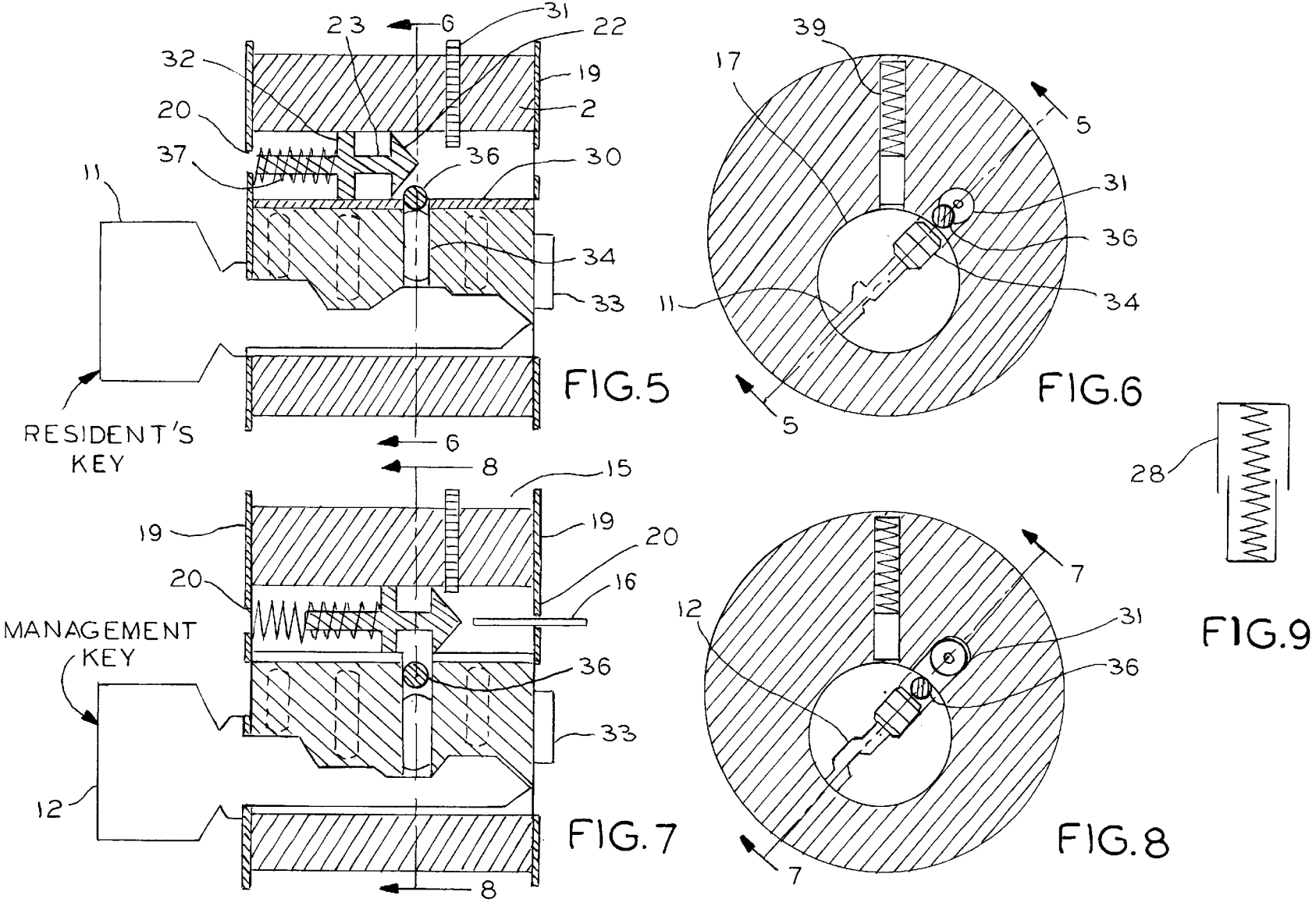
FIG. 5 is a cross-section of another embodiment of the tumbler cylinder lock showing abnormal use indicator position when resident's key is in place.
FIG. 6 is a cross-section taken along lines VI—VI of FIG. 5.
FIG. 7 is a cross-section of the embodiment shown in FIG. 5 showing abnormal use indicator position when management key is in place.
FIG. 8 is a cross-section taken along lines VIII—VIII of FIG. 7.
FIG. 9 shows a typical telescoping spring loaded pin as used in the mechanism.

Lower spring loaded telescoping pin 28 urges ball or pin 36 upwardly against notched block 14, which is biased downwardly by an upper spring 35. Lower spring loaded telescoping pin 28 is shown in FIG. 9 has a fixed extended length and is able to be compressed and shortened in length. This aids in keeping the lock operational after the lock and indicator have been tripped.

Figure 1:
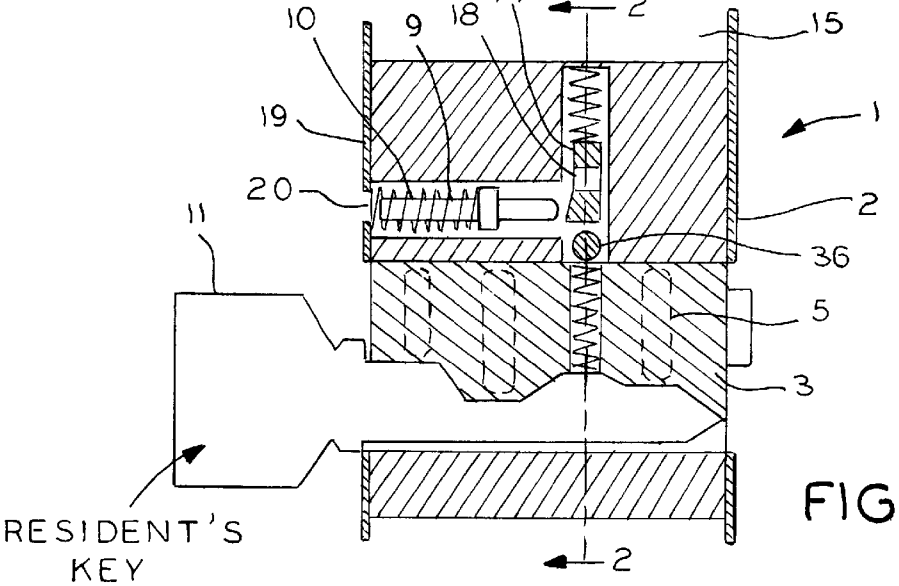
FIG. 1 of the drawings is a cross-section of a tumbler cylinder lock showing abnormal use indicator position when resident's key is in place.

In this condition, axial pin 9 is held in the FIG. 1 position, unable to move to the right, even though urged in that direction by axial pin spring 10, by virtue of being obstructed by notched block 14. In this condition, the distal end of pin 9 is flush with the surface of door 15, and is plainly visible through opening 20 in door plate 19.

Figure 2:
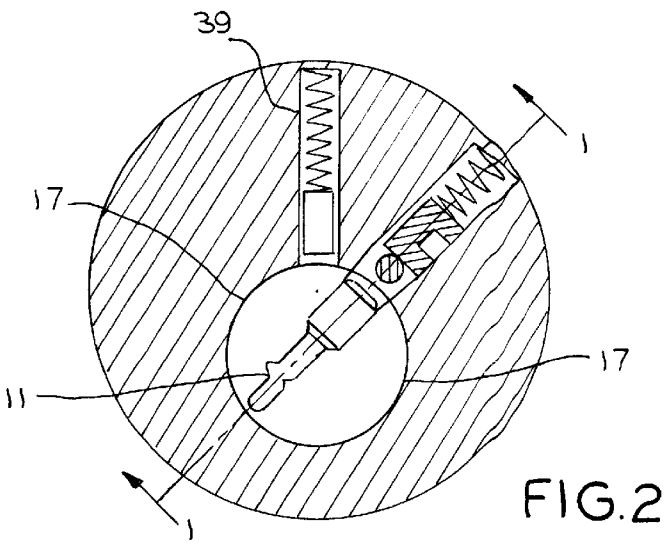
FIG. 2 is a cross-section taken along lines II—II of FIG. 1.
Figure 4:
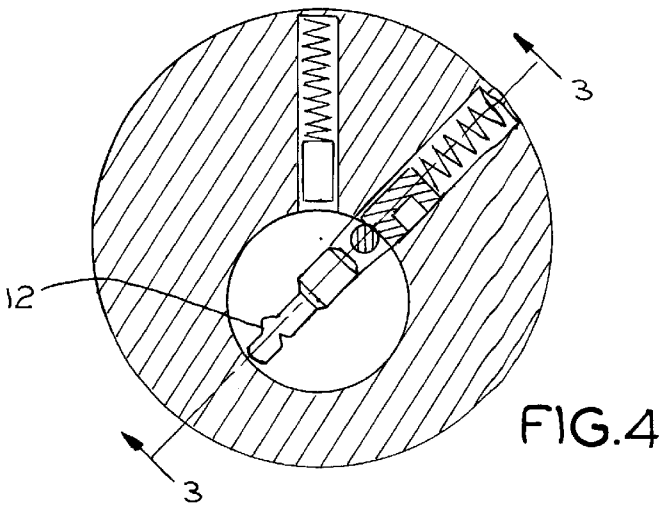
FIG. 4 is a cross-section taken along lines IV—IV of FIG. 3.

As shown in FIG. 2, there is no obstruction along the shear line 17, and rotation of the cylinder is not affected by the indicator arrangement.

Figure 3:
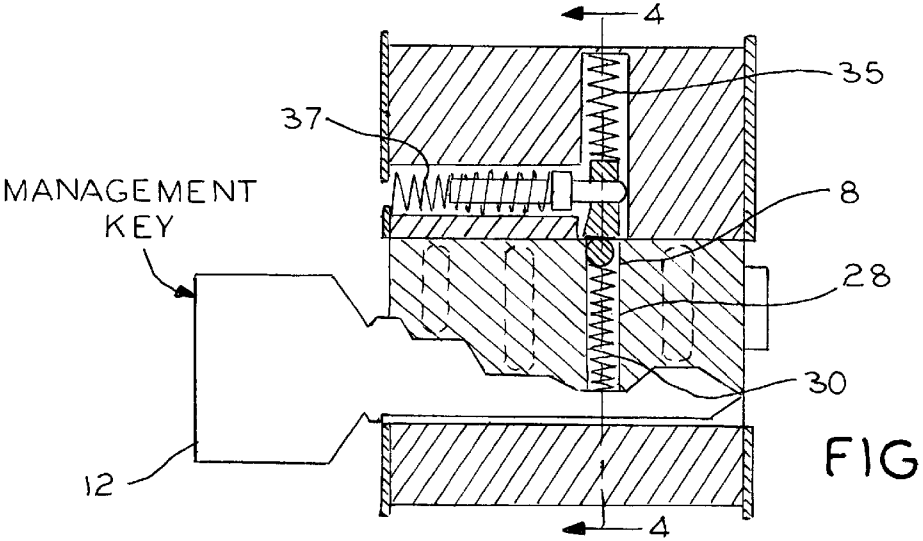
FIG. 3 is a cross-section of the tumbler cylinder lock showing abnormal use indicator position when management key is in place.

With the management key 12 in the lock, as shown in FIG. 3, the unique indentation of the key ridge, which is lower at the critical point of contact, than is the resident's key 11, causes lower spring or pin 28 to move to a lower position and allow ball or pin 36, urged by upper notched block 14 and upper spring 35, to move into cylinder pin channel 8.

The displacement of ball 36, allows displacement of notched block 14 at the urging of upper spring 35. This shift in position enables the proximal end of axial pin 9 to enter the block slot 18, enabling the axial pin 9 to be displaced to the right, as shown in FIG. 3.

This causes the distal end of the axial pin to move inwardly from the door plate 19, and hence, is not readily visible through door plate opening 20.

The lock is fully operable in this condition, but the resident know that the management key was used to gain entry through or to unlock the door.

The lock indicator is readily re-set by usual disassembly. This may be accomplished by removal of door plate (19) and removal and resetting axial pin (9) and axial spring (10).

In the alternative embodiment of this invention, the basic concept applies, but the structure is different.

Like parts are identified by the same reference numerals.

FIG. 5 shows the structure with an authorized resident's key in the cylinder.

The pin 34 engages the ridge surface of key 11 and keeps the ball or pin 36 above the shear line 17, enabling the cylinder to freely rotate, and engage a lock mechanism through actuator 33.

The position of ball 36 acts to obstruct or restrain rightward movement of the cone tipped axial plug 32. The distal end of the axial plug is readily visible through the door plate opening 20 in this non-actuated condition.

When management key is used as shown in FIG. 7, the lower key surface portion permits downward movement of the pin 34, allowing ball or pin 36 to be forced downwardly into channel 30 by action of the coned tip 22 of axial plug 32. This removes the restraint of rightward movement of the plug 32. The axial spring 37 moves the plug 32 to the right until it is stopped by the cone tip stop 40 which can be in the form of a projecting screw threaded into the housing 2.

This then removes the distal end of the plug 32 from the opening 20 in the door plate 19, making the end axial plug not visible, and thus giving notice that the door had been unlocked by the management key.

In this condition the lock will continue to function normally, when the resident's key is inserted into the lock, the higher ridge at the critical point on the key will force the pin 34 upwardly, causing ball 36 to move upwardly and be positioned in a circumferential groove 23 in the body of the axial plug 32.

The ball 36 will remain in that position until the mechanism is re-set.

To reset, with ball in the channel 30, a re-setting wire or pin 16 is needed. Also needed is the management key, or a copy. The management key is inserted and rotated to be aligned with the pin 31 that was tripped. The re-setting wire or pin 16 is then inserted into an opening 38 in the door plate 19. Pin 16 is moved to the left, and engages the cone tip 22 of the plug 32, and moves the plug to the left until the nose tip 22 clears the ball 36, whereupon the ball can be moved upwardly by rotating the resident's key to lift pin 34 and move ball into the housing, whereupon it will be maintained in normal condition.

Any rod or stiff wire 16 may be used for resetting. The rod is guided by a passageway not shown.

The drawings of this invention do not attempt to describe, in detail the structure of a conventional lock with radial pin channels in the housing and corresponding pin channels in the cylinder. The channels in the housing are schematically shown in the cross-section views of FIGS. 2, 4, 6 and 8. It is important that channels in the housing which relate to the improvements described herein are disposed at an angle apart from the lock actuating channels in the housing.

I claim:

1. In a door lock having, a cylinder housing for mounting within a door, a cylinder disposed for rotation within the housing, a row of radial channels in the housing, a matching row of radial channels in the cylinder, and spring loaded pins of selected lengths slidably disposed within said channels and adapted to be radially positioned by a profile section of a first selected key to permit rotation of the cylinder within the housing, the improvement comprising:

at least one other channel radially disposed in the housing and in the cylinder at an angle apart from the first rows of channels, a further pin member slidably disposed in said other radial channel, the position of which is determined by the engaging surface of a second selected key, a spring loaded axial pin assembly disposed for axial movement within the housing, and restraining means urged radially outwardly by the further pin member for holding the axial pin assembly in an externally visible position, said restraining means being moved out of engagement with said axial pin assembly upon radial inward movement of the further pin member when engaged with a depressed profile section of the second selected key, allowing the release of the spring loaded axial pin assembly to the externally non-visible position in the door.

2. Door lock as claimed in claim 1 wherein said restraining means comprises a spring loaded block (14) slidably disposed in said other radial channel in the housing, and an intermediate member (36) in contact with the proximal end of the block and being in contact with said further pin member (28) which is spring loaded.

3. Door lock as claimed in claim 2 wherein a slot in the body of said block permits passage of the spring loaded axial pin assembly upon predetermined radial movement of said block.

4. Door lock as claimed in claim 2 comprising radially disposed upper spring means (35) for urging said slidable block (14) and intermediate member (36) inwardly, with said further pin member (28) urging said intermediate member and said sliding block outwardly and the radial position of the block being determined by the profile section of the first and second keys.

5. Door lock means as claimed in claim 1 wherein said spring loaded axial pin assembly comprises:

plug member (32) axially slidable in the housing between externally visible and non-visible positions, a cone tip (22) at one of the plug member, an intermediate member comprising a ball (36) urged into or out of engagement with the cone tip depending upon the profile section of the key that is engaged in the cylinder.

6. Door lock as claimed in claim 5, wherein plug member (32) comprises a circumferential groove (23) for receiving said ball (36) after release of the spring loaded axial assembly to the externally non-visible position, and upon insertion of the first selected key.

7. Door lock as claimed in claim 5 comprising:

a cone tip stop (31) disposed in the housing and projected into the path of movement of plug member (32) to engage and limit axial movement of the cone tip (22).

8. Door lock as claimed in claim 5 comprising:

resetting means (16) insertable through an opening (20) in a door plate (19) for engaging cone tip (22) and moving plug member (32) axially to the externally visible position.

* * * * *